US005347719A

United States Patent [19]

Scharf

[11] Patent Number: 5,347,719

[45] Date of Patent: Sep. 20, 1994

[54] DEVICE FOR LIFTING AND CUTTING GLUED-DOWN CARPET

[76] Inventor: Gary Scharf, 9825 Carroll Ctr. Rd., #200, San Diego, Calif. 92126

[21] Appl. No.: 119,375

[22] Filed: Sep. 13, 1993

[51] Int. Cl.[5] ..... B26B 3/08

[52] U.S. Cl. ..... 30/294; 30/315

[58] Field of Search ..... 30/294, 289, 290, 296.1, 30/278, 280, 281, 315

[56] References Cited

U.S. PATENT DOCUMENTS

| | | | |
|---|---|---|---|
| 2,601,414 | 6/1952 | Mittelstaedt | 30/294 |
| 2,721,384 | 10/1955 | Bell | 30/294 X |
| 2,806,283 | 9/1957 | Brennan | 30/294 |
| 3,486,228 | 12/1969 | James | 30/294 |
| 3,859,725 | 1/1975 | Anderson | 30/294 |
| 4,198,751 | 4/1980 | Egbert | 30/294 X |
| 5,159,758 | 11/1992 | MacDonald | 30/294 |

*Primary Examiner*—Rinaldi I. Rada
*Attorney, Agent, or Firm*—Charles C. Logan, II

[57] ABSTRACT

A device for lifting and cutting glued-down carpet that is made of three primary components, a handle, a blade mounting plate and a rod mounting sleeve. The blade mounting plate is secured to the front end of the handle and the rod mounting sleeve is secured to the bottom of the two previous components. A blade cover plate secures a razor blade between itself and the blade mounting plate with the bottom edge of the razor blade captured in a groove that extends along the top surface of the carpet lifting rod. The carpet lifting rod is longitudinally adjustable within the rod mounting sleeve. In operation, the pointed front end of the carpet lifting rod is driven along the top surface of the concrete below the bottom surface of the carpet thereby lifting it up to a position where it is cut by the razor blade as the device is continuously pushed along beneath the carpet.

7 Claims, 1 Drawing Sheet

DEVICE FOR LIFTING AND CUTTING GLUED-DOWN CARPET

BACKGROUND OF THE INVENTION

The invention relates to a carpet removing device, and more specifically a device for lifting, and cutting carpet that has been glued to a concrete surface or other typed of support surface.

There are several situations where carpet is glued to its supporting surface. Some instances are in shopping malls, commercial offices, motels, hotels, etc. The glue used is an extremely strong adhesive making it very difficult to remove carpet for replacement purposes. Normally a crew of several men must pry up small sections of carpet at a time. This is very hard physical work and expensive to do. The work of prying up carpet often results in strained back muscles and other physical problems.

It is an object of the invention to provide a novel device for both lifting and cutting glued-down carpet in a single operation.

It is also an object an object of the invention to provide a novel device for lifting and cutting glued-down carpet that eliminates the strains that are normally placed on the person's back and other muscles when trying to pry up the carpet.

It is another object of the invention to provide a novel device for removing glued-down carpet that allows the removal to be accomplished in a much shorter period of time and at a reduced cost.

It is an additional object of the invention to provide a novel device for lifting and cutting glued-down carpet that is economical to manufacture and market.

SUMMARY OF THE INVENTION

The device for lifting and cutting glued-down carpet has for its basic structure, an elongated handle that would normally be between 4 and 7 feet long. The bottom end of the handle has a bottom leg portion that is bent at an obtuse angle to the longitudinal axis of the main body portion of the handle. A blade mounting plate is welded to the front end of the bottom leg portion so that it is oriented in a vertical plane. A rod mounting sleeve is welded to the bottom edge of the blade mounting plate and also the bottom surface of the bottom leg portion of the handle. The handle, the blade mounting plate and the rod mounting sleeve would preferably be made of steel.

The rod mounting sleeve is cylindrical and a carpet lifting rod is telescopically mounted therein. A set screw allows the carpet lifting rod to be moved longitudinally as its pointed front end wears away due to continued use. A set screw locks the carpet lifting rod in place. The front surface of the rod mounting sleeve has a sloped or rearwardly inclined planar surface that helps i t slide past the edges of the cut carpet. A longitudinally extending groove is formed in the top surface of the carpet lifting rod and its purpose will be explained later.

The blade mounting plate is longitudinally aligned parallel to the carpet lifting rod. It has a pair of dowels extending transversely from its one side wall that register with recesses in the rear edge of the razor blade used with the device. The razor blade has a front cutting edge that is oriented forwardly in the same direction as the pointed front end of the carpet lifting rod. The bottom edge of the razor blade is captured within the groove on the top surface of the carpet lifting rod and it keeps the blade from flexing and easily breaking. It also prevents carpet material from clogging the area under the bottom edge of the blade and binding up the device. A blade cover plate is detachably secured to the blade mounting plate with the razor blade sandwiched therebetween.

In an alternative embodiment of the device for lifting and cutting glued-down carpet, the handle has a mating mounting plate that is pivotally secured to the blade mounting plate. This allows the obtuse angle between the two members to be adjusted according to the height of the person using it.

The manner in which the device for lifting and cutting glued-down carpet is used is fairly simple. The front pointed end of the carpet lifting rod is pushed into the area between the top surface of the concrete and the bottom surface of the carpet. Continuous force is applied and as the carpet lifting rod is moved forward it lifts the carpet and the carpet is fed passed the front cutting edge of the razor blade. This allows the person using the device to cut the glued-down carpet into strips of carpets that are then removed with another of the applicant's inventions.

DESCRIPTION OF THE PREFERRED EMBODIMENT

Figure 1:
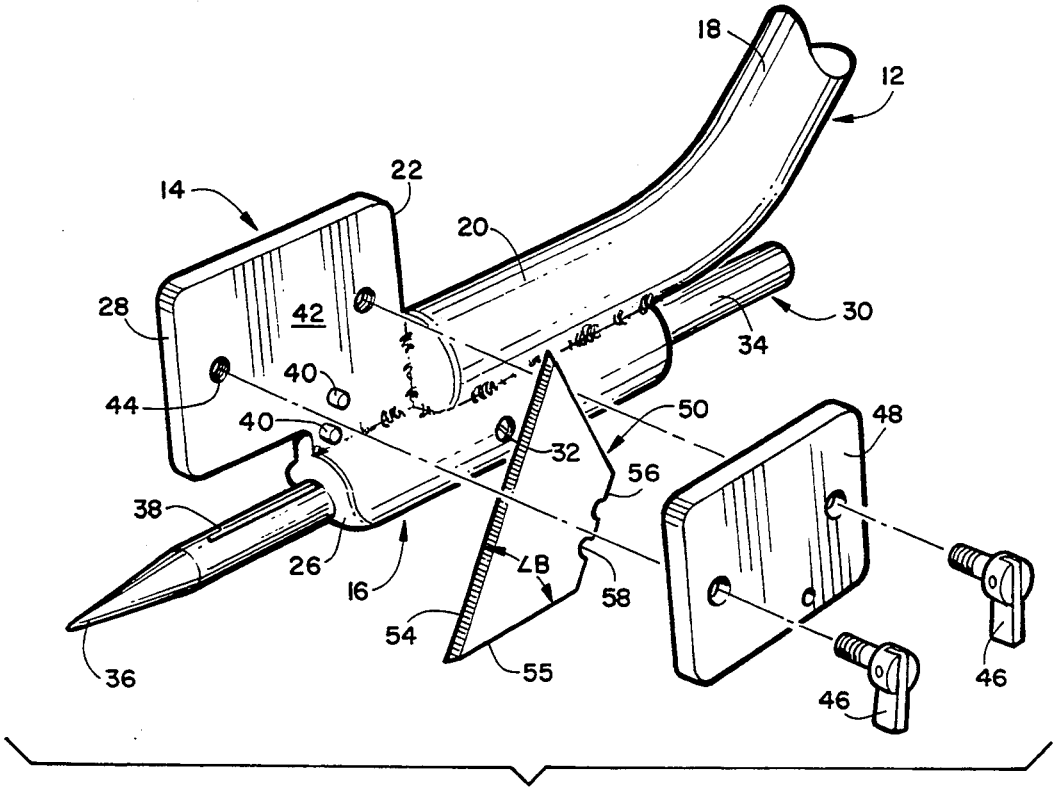
FIG. 1 is an exploded front perspective view of the bottom portion of the device for lifting and cutting glued-down carpet.
Figure 2:
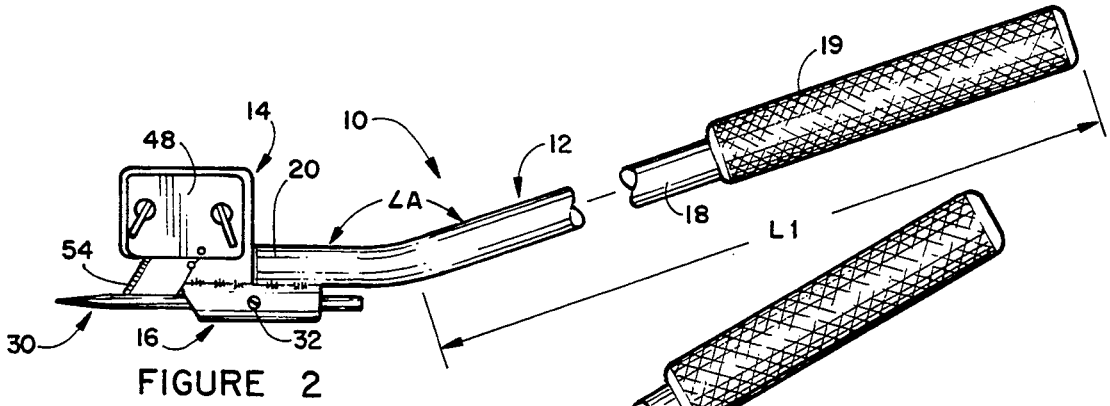
FIG. 2 is a side elevation view of the device for lifting and cutting glued-down carpet.

The novel device for lifting and cutting glued-down carpet will now be described by referring to FIGS. 1–4 of the drawing. The device is generally designated numeral 10.

The main components of the device 10 are the handle 12, the blade mounting plate 14, and the rod mounting sleeve 16.

The handle has an elongated main body portion 18 that is between 4 and 7 feet long L1. It has a textured gripping portion 19 adjacent its top end. It has a bottom leg portion 20 that makes an obtuse angle A with the longitudinal axis of the main body portion 18.

The blade mounting plate 14 is vertically oriented and its rear end 22 is welded to the front end of bottom leg portion 20. The rod mounting sleeve 16 is welded to the bottom of blade mounting plate 14 and also bottom leg portion 20. The front rearwardly sloped planar surface 26 of rod mounting sleeve 16 is spaced rearwardly from the front end 28 of blade mounting plate 14.

Rod mounting sleeve 16 has a longitudinally extending bore which telescopically receives a carpet lifting rod 30. It can be secured in a longitudinal position by a set screw 32. Carpet lifting rod 30 has a shank portion 34 and a pointed front end 36. A longitudinally extending groove 38 is formed in the top surface of shank portion 34.

Blade mounting plate 14 has a pair of dowels 40 extending transversely from its side wall 42. A pair of threaded bores 44 releasably receive the ends of locking screws 46 when blade cover plate 48 is attached thereto with razor blade 50 sandwiched there between. Razor blade 50 has a front cutting edge 54, a bottom edge 55 and a rear edge 56. A plurality of alignment recesses 58 are formed in rear edge 56 and they mate with dowels 40 for orienting the razor blade 50 in its proper position. Bottom edge 55 rests in groove 38 of the carpet lifting rod 30.

Figure 3:
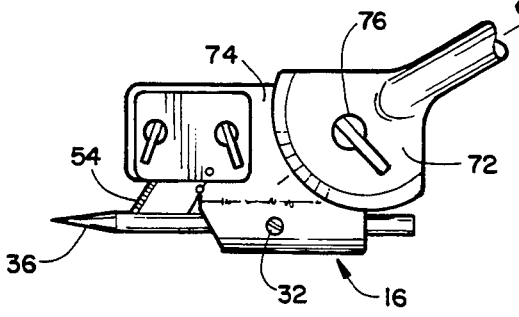
FIG. 3 is a side elevation view of a first alternative embodiment of the device for lifting and cutting glued-down carpet.

An alternative embodiment of the device for lifting and cutting glued-down carpet is illustrated in FIG. 3. Its handle 70 has a mounting plate 72 that is pivotally secured to mounting plate 74 and locked in place by a set screw 76. Angle marks are located on the adjacent mounting plates in order to have a precise reading for the obtuse angle between the two members. The remainder of the structure of the two devices is substantially identical and is identified by the same numerals utilized with the previously described embodiment.

Figure 4:
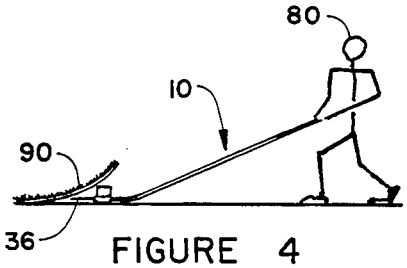
FIG. 4 is a schematic illustration showing the manner in which a person uses the device for lifting and cutting glued-down carpet.

FIG. 4 is a schematic diagram showing a person 80 using the device 10 for lifting and cutting glued-down carpet and the manner in which the pointed front end 36 is driven underneath the carpet 90 and lifted prior to its being cut by razor blade 50.

What is claimed is:

1. A device for lifting and cutting glued-down carpet comprising:

an elongated handle having a predetermined length L1, said handle having a longitudinally extending main body portion having a top end and a bottom end;

primary mounting means are secured to said handle adjacent its bottom end for holding a blade and it has a blade mounting plate having a front end, a rear end, a top edge, a bottom edge and a side wall; it also has a blade cover plate and means for detachably securing it to said blade mounting plate with said blade sandwiched therebetween;

secondary mounting means are secured to said handle adjacent its bottom end for holding a carpet lifting rod;

an elongated carpet lifting rod having a longitudinally extending axis, said carpet lifting rod having a shank portion and pointed front end portion, said carpet lifting rod is secured to said secondary mounting means; and a blade having a front cutting edge, a bottom edge and a rear edge, said blade being secured to said primary mounting means with its cutting edge oriented forwardly.

2. A device for lifting and cutting glued-down carpet as recited in claim 1 wherein L1 is between 4 and 7 feet in length.

3. A device for lifting and cutting glued-down carpet as recited in claim 1 wherein said handle has a bottom leg portion having a longitudinal axis that intersects the longitudinal axis of said main body portion at an obtuse angle A.

4. A device for lifting and cutting glued-down carpet as recited in claim 1 further comprising means for adjusting an angle that the longitudinal axis of the main body portion of said handle makes with said primary mounting means.

5. A device for lifting and cutting glued-down carpet as recited in claim 1 further comprising means for aligning the front cutting edge of said blade.

6. A device for lifting and cutting glued-down carpet comprising:

an elongated handle having a predetermined length L1, said handle having a longitudinally extending main body portion having a top end and a bottom end;

primary mounting means are secured to said handle adjacent its bottom end for holding a blade;

secondary mounting means are secured to said handle adjacent its bottom end for holding a carpet lifting rod;

an elongated carpet lifting rod having a longitudinally extending axis, said carpet lifting rod having a shank portion and a pointed front end portion, said carpet lifting rod secured to said secondary mounting means;

said secondary mounting means having a rod mounting sleeve having a longitudinally extending axis and the shank portion of said rod being longitudinally adjustable in said rod mounting sleeve; and a blade having a front cutting edge, a bottom edge and a rear edge, said blade being secured to said primary mounting means with its cutting edge oriented forwardly.

7. A device for lifting and cutting glued-down carpet as recited in claim 6 wherein the shank portion of said carpet lifting rod has a top surface having a longitudinally extending groove that removably receives the bottom edge of said blade.

* * * * *